US005134920A

United States Patent [19]

Clark

[11] Patent Number: 5,134,920

[45] Date of Patent: Aug. 4, 1992

[54] TRANSDUCER DEVICE FOR MUSICAL INSTRUMENTS

[76] Inventor: Bradley R. Clark, 53 Hardware Lane, Melbourne, Victoria 3000, Australia

[21] Appl. No.: 696,751

[22] Filed: Mar. 20, 1991

[30] Foreign Application Priority Data

Sep. 20, 1988 [AU] Australia ..... PJ0537

Sep. 20, 1989 [AU] Australia ..... PCT/AU89/00406

[51] Int. Cl.[5] ..... G10H 3/12

[52] U.S. Cl. ..... 84/730; 84/477 R; 84/DIG. 12; 84/DIG. 24

[58] Field of Search ..... 84/723-743, 84/DIG. 12, DIG. 24, 477 R, 478

[56] References Cited

U.S. PATENT DOCUMENTS 3,725,561 4/1973 Paul ..... 84/DIG. 12

4,147,084 4/1979 Underwood ..... 84/DIG. 24

4,201,107 5/1980 Barber, Jr. et al. ..... 84/DIG. 12

4,418,598 12/1983 Klynas ..... 84/DIG. 12

4,546,687 10/1985 Clark ..... 84/477 R X

*Primary Examiner*—Stanley J. Witkowski

*Attorney, Agent, or Firm*—Abelman Frayne & Schwab

[57] ABSTRACT

Transducer device (12) for drums including a head structure (18) mountable to a drum by means of a mounting structure (20). The head structure includes a piezo electric transducer (24) clamped between metal plates (26, 28), plate (26) forces against the drum skin (16) by application of force through the mounting structure (20). The force is applied to a plate (34) forming part of the head structure (18) which is acoustically isolated from the transducer (24) by an isolating element (36) positioned between the plates (34) and (28). Electrical output is taken via a cable (36) to a preamplifier (74).

7 Claims, 3 Drawing Sheets

TRANSDUCER DEVICE FOR MUSICAL INSTRUMENTS

This invention relates to a transducer device for musical instruments.

In modern recording techniques for musical groups, it is usually the case that many of the instruments are electric or electronic instruments which provide electric signal outputs. In some instances, these outputs may be the only outputs directly produced, use being made of amplifiers and loundspeakers for the output to provide the sole acoustic output. This is usually the case in respect of synthesizers. In other cases the signal may be additional to an originally produced acoustic output signal, although the acoustic signal may not necessarily be significant, such as in the case of solid body electric guitars or basses.

Recordings are most usually made by multi-tracking techniques in which each track of the multi-track recording has laid down therein signal corresponding to, most preferably, one instrument only. Signals from these tracks are than mixed in various fashions to combine the signals, adjust signal levels, and to add musical or other effects as required to make the final recording. As mentioned, where practicable, each original track is devoted only to a single respective one of the instruments and it is important, for best results in the subsequent mixing procedures, that each track be as free from contamination by signal output from other instruments as is practicable. That is to say, if, say, two tracks intended to separately record each of two instruments in the first instance each contained substantial signal information from the other instrument, mixing flexibility is lessened, since it is hardly then possible, by mixing these two tracks in different proportions, to significantly alter the musical balance between the signal outputs of the two instruments.

In modern rock groups or the like, it is frequently the case that all of the instruments provide direct eletrical output as mentioned above, with the exception of acoustic drums. However, other instruments may produce some acoustic output and indeed some output is necessary in order to enable performers to hear their performance, even if this is only provided by headphones. In any event, for one reason or another, there is usually at least one other significant competing source of sound in the recording studio, aside from that produced by the drums. In consequence of this, microphones intended to pick up only the drum sound will likely produce a recorded signal which is contaminated by sound from other sources if a microphone is used for the drums, as is customary. This effect is known as "crosstalk" or "spill". A similar difficulty arises where separate recording of different drums is required. For example, the musical group may wish to sing while the recording is in progress, even if that singing is not recorded, at that time, as a track which is to be used ultimately in the recording, and may wish to have significant sound output, via loudspeaders, in the recording studio, corresponding to the performance. For these reasons, during the recording session, it is customary to provide substantial sound insulation around the drummer and his drums in order to prevent contamination of the microphone output for the drums by any other sound sources. This technique may or may not be entirely successful depending upon the level of the competing sound sources but, even if successful, has a substantial disadvantage in that it results in the drummer being physically isolated, because of the necessary sound insulating materials, from the remainder of the recording group so that he is not easily able to follow what is happening during performance. Thus, the recordings may be less musically satisfactory, from a technical or artistic point of view, than would be desirable.

An object of the invention is to provide a transducer device for musical instruments and adapted to be fitted to a drum, percussive instrument or other musical instrument to provide an electrical output which may be used to represent the sound of the instrument in place of customary microphones.

In accordance with one aspect of the present invention there is provided a transducer device for musical instruments, such as percussive instruments, comprising a transducer effective when subjected to audio frequency vibration to produce a corresponding electrical signal output, and mounting structure for mounting the transducer to the instrument such that it is coupled to a surface thereof for transmission of vibration of that surface to the transducer, for producing a corresponding said signal output therefrom, said mounting structure being effective in use of the transducer device to press the transducer towards said surface, said transducer device including isolating means effective in use to reduce transmission of vibration to said transducer via the mounting structure.

The transducer may be incorporated into a head structure comprising two relatively rigid elements, between which the transducer is clamped, and a third relatively rigid element interconnected with one of said first mentioned elements, or said transducer, by said isolating means.

The isolating means may comprise, for example, a resilient member such as a member formed of resilient foam rubber or foam plastics but may be formed of any other suitable material capable of effective damping of vibrations.

The mouunting structure may include a mounting element attachable to the instrument and an arm extending therefrom and couplable at an end thereof remote from the mounting element to said third element, means being provided for exerting a clamping force on the transducer via the arm.

The coupling of the arm to the third element may be effected via a suitable vibration dampening element.

Preferably, the transducer is a piezo-electric device.

In another aspect, the invention provides a method of recording a musical group comprising one or more musical instruments including a drum or other percussive instrument, wherein the drum or other percussive instrument is provided with said transducer device and the electric output therefrom is applied directly, or otherwise such as after signal transformation (for example digitisation or other modification) to make a recording on a recording medium such as magnetic tape. Alternatively, or additionally, the output may be used to initiate output of other electrical signals, such as signals representing other musical outputs.

In a modification of the invention, the transducer device includes means effective to analyse electrical signal produced thereby and provide an indication, such as by visual read out means, of the frequency of the vibrations detected by the device.

In another modification, a preamplifier is provided for the transducer, which preamplifier incorporates tone modification circuitry such as a parametric equalizer.

The invention is further described by way of example only with reference to the accompanying drawings in which.

Figure 1:
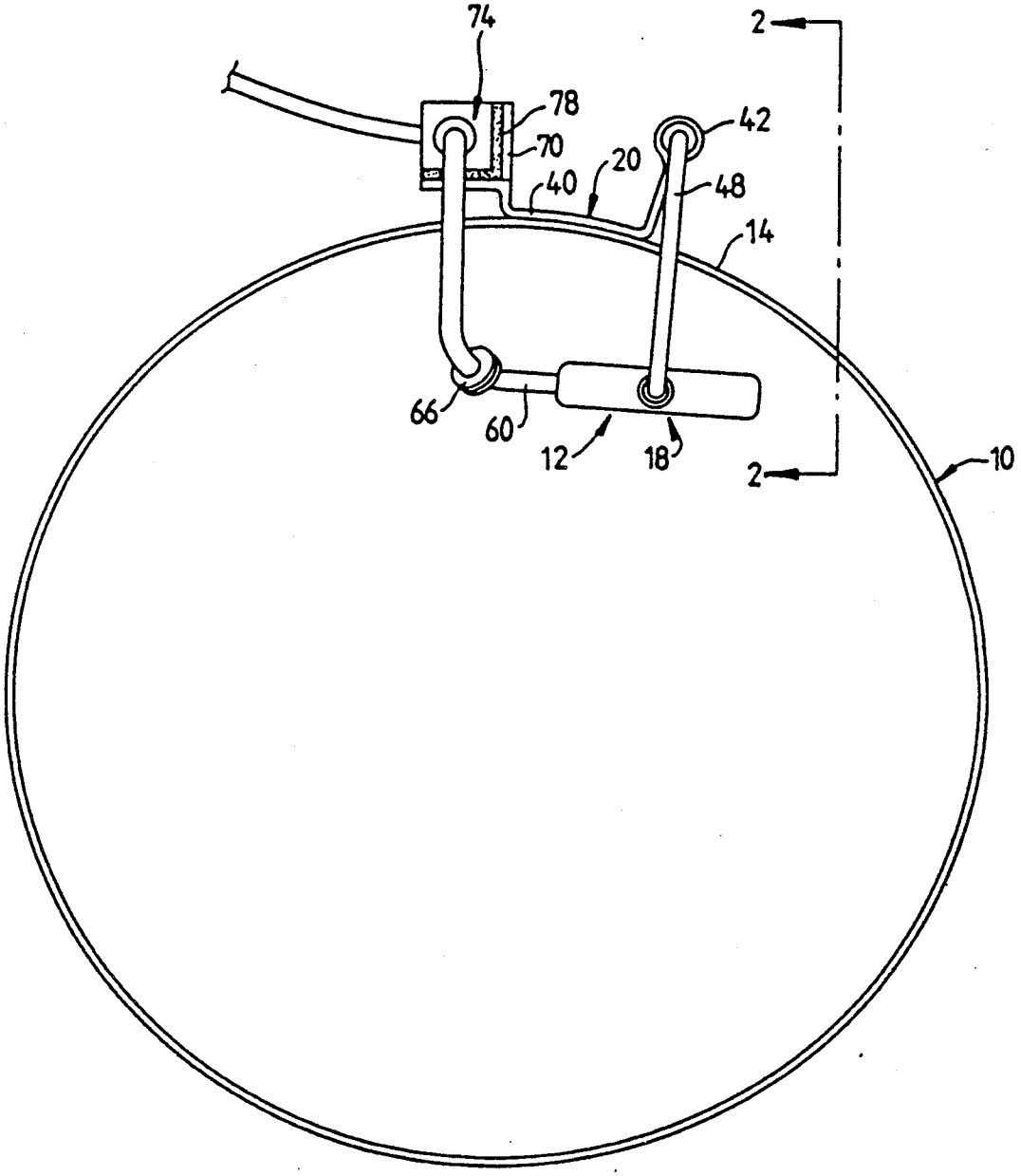
FIG. 1 is a plan view of a drum fitted with a transducer device constructed in accordance with the invention.

FIG. 1 shows a drum 10 fitted with a transducer device 12 constructed in accordance with the invention. The drum, which is shown only diagrammatically, is of conventional construction having a cylindrical side wall 14 and a drum skin 16.

Figure 2:
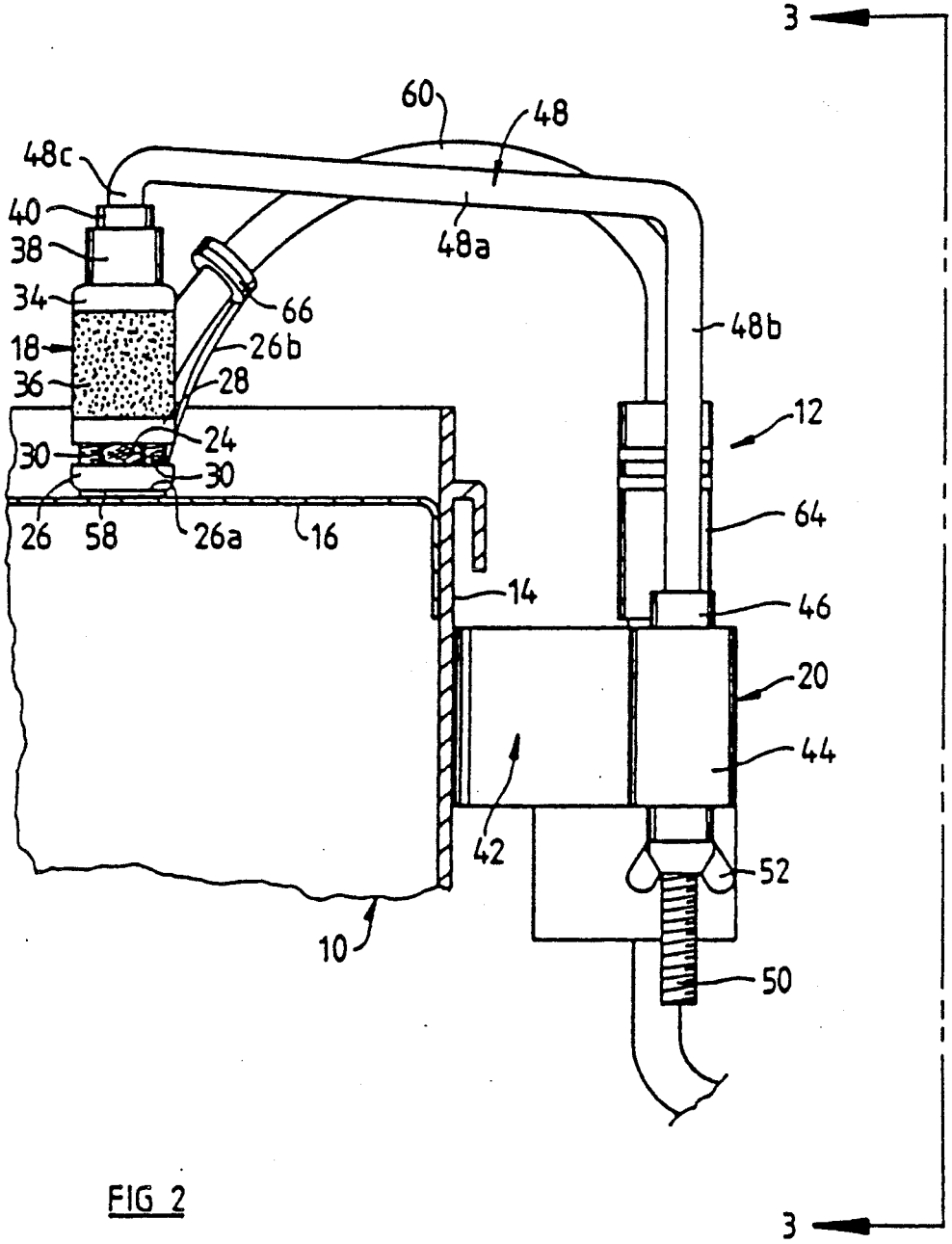
FIG. 2 is a view approximately on the line 2—2 FIG. 1.
Figure 3:
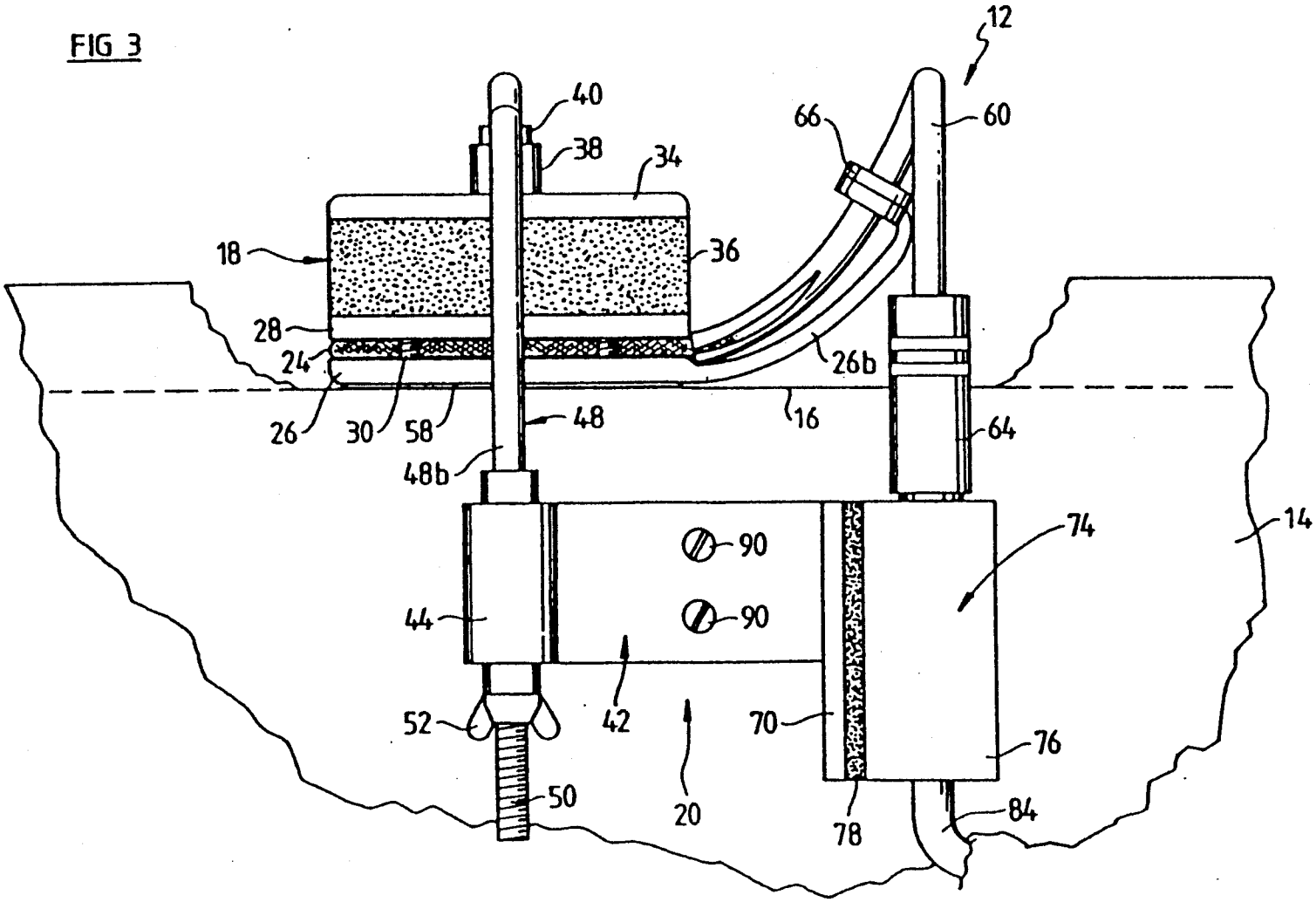
FIG. 3 is a view on the line 3—3 in FIG. 2.

The transducer device 12 includes a head structure 18 and a mounting structure 20. As shown in FIGS. 2 and 3, the head structure 18 comprises a piezo-electric transducer 24 which is clamped between two flat elongate plates 26, 28 by means of screws 30 which extend through openings in the lower of the two plates as depicted in FIGS. 2 and 3, plate 26, and thence into threaded openings in plate 28. It has been found that, for the transducer 24 to operate effectively, it must be subjected to compressive force and the clamping action provided by virtue of sandwiching of the transducer between the plates 26, 28, and by use of the screws 30, ensures that adequate compressing force is provided.

The under-surface 26*a* of plate 26 is smooth, the heads of the screws 30 being made flush therewith, such as by grinding.

The head structure 18 includes a further elongate plate 34 which, in the orientation shown in FIG. 2, is positioned above plate 28. Plate 34 is interconnected with plate 28 by means of an isolating element 36 formed, for example, of foam rubber. It has been found convenient to glue the element 36 to the plates 34 and 28.

Plate 34 has an upstanding bush 38 thereon which is affixed thereto, this being provided with a central opening in which a vibration dampling element in the form of an annular collar 40 is positioned and retained.

The mounting structure 20 includes a mounting element 42 which is secured, as by screwing, to the side wall of the drum. Mounting element 42 is provided with a bushing 44 having a central opening therethrough, within which is positioned a nylon sleeve 46.

The structure 20 further includes a somewhat U-shaped arm 48 having a central portion 48*a* from opposite ends of which extend generally parallel portion 48*b*, 48*c*. The free end of portion 48*c* extend into collar 40 whilst the free end of portion 48*b* extends through sleeve 46. Portion 48*b* has a threaded outer end 50 projecting from bushing 44, on which is threadedly received a wing-nut 52. By screwing up wing-nut 52 on end 50, portion 48*b* of arm 48 is drawn through the bushing 44 so as to apply pressure, via portion 48*a* and portion 48*c*, against the plate 34, thus somewhat compressing the isolating element 36 and applying force through plate 28, screws 30 and transducer 24 to plate 26 so that plate 26 is thus firmly pressed against the outer surface of the drum skin 16. To further facilitate location of the head structure 18 on the drum skin, a strip of double sided adhesive tape 58 may be positioned along the under-surface of plate 26, being secured thereto as well as to the drum skin surface.

Electrical leads from the transducer 24 are taken, via a suitable cable 60 such as a coaxial cable, to a suitable connector such as the phone jack type connector 64 shown. To provide further acoustic vibration decoupling, a portion of the cable 60 adjacent the head structure 18 is supported in a resilient rubber bushing 66. Bushing 66 is supported on an extension 26*b* of plate 26, the bushing being attached to the extension 26*b* thereto such as by gluing or the like.

Mounting element 42 also has a further angle-section bracket portion 70 to which is secured a preamplifier device 74, this having an outer casing 76 which is so secured to the bracket portion 70 by virtue of being secured to a layer 78 of sound insulating material, such as foam rubber, which itself is attached to the bracket portion 70. The layer 78 provides further decoupling of vibration relative to the preamplifier device. The preamplifier device has an output cable 84 for output of signal from the device 12.

In a preferred construction, the plates 26, 28 are of metal and the plate 34 may likewise be formed of metal. The clamping provided to the transducer, aside from assisting in increasing the sensitivity thereof, provides a surface of more substantial area for the conduct of acoustic vibration to the transducer, such surface being provided by the undersurface 26*a* of plate 26.

As shown particularly in FIG. 3, the mounting element 42 may be screwed to the drum side wall by use of screws 90 extending through openings (not shown) in the mounting element and thence into the side wall of the drum, but the mounting element could be of different form and may for example be incorporated into some existing part of the drum such as existing drumhead lugs.

The provision of the arm 48 in the form shown, as comprising a simple demountable U-shaped structure formable by bending of metal rod, permits ready formation of a variety of differently formed arms to adapt the device 12 for use with different types of drums.

While the device 12 is shown as being attached externally to the drum, it could be equally attached internally, so that the head structure 18 was biased against an inner surface of the drum head rather than the outer surface shown.

In use, with the device affixed to a drum as shown, vibrations of the drum skin as the drummer plays the drum are transduced to corresponding electrical signals which faithfully represent the sound produced by the drum. These signals are amplified in preamplifier device 74 and applied as desired in the recording process.

Use of the device 12 provides a simple means for generating an electrical signal at the output of the preamplifier 74 which, as mentioned, faithfully represents the sound of the drum whilst providing for good immunity against pick-up of stray vibration or the like. It has been found practicable to employ the device 12 in the making of recordings whereby the electrical output from the transducer device provides substantially uncontaminated sound signal which does not, of course, pick up sound from other musical instruments or voices so that the drummer may easily be accommodated in the recording studio with minimal or no special attention being needed to provide sound insulation from the remainder of the recording group. Thus the performers may each be in a position to see what the other performers are doing during performance, thus aiding artistic and technical expression.

Of course, the device 12 may be employed during live performances, with the output therefrom applied to generate sound signals via suitable amplifiers and loudspeakers.

In a modification, the preamplifier device 74 incorporates means of a kind known per se for frequency analysis of the signal produced by transducer 24 and read-out means, such as a liquid crystal display, for display of the dominant frequency of vibration of the drum skin, thereby permitting accurate tuning of the drum. Additionally or alternatively, the preamplifier incorporates tone control circuitry, such as a parametric equalizer, effective to permit variation of the tone of sound signals reproduced or recorded by use of the device 12.

While the invention has been described in the context of a device suitable for use with drums, the device may be used inconjunction with other percussive instruments such as cymbals and high-hats, as well as with other musical instruments having diaphrams, sound boards or the like to which the head structure of the device may be brought into contact and which in use of the instrument produce musical sound by vibration.

The device as above described is also particularly advantageously employable for producing a relatively distinct triggering signal which may be used for various purposes, such as to trigger a recording apparatus. This arises because the device faithfully reproduces high transient signals, such as "spikes", arising when the percussion instrument is struck, whilst excluding extraneous signals, such as those arising from other drums. For example, the signal produced on striking the percussion instrument may be readily employed to cause a recording apparatus to initiate playback of a previously recorded signal, such as a prerecorded signal derived from another percussive instrument, or even the same instrument recorded earlier, such as in a different environment. Thus, a desired drum signal may have been prerecorded and stored and, on striking a drum fitted with the device of the invention, the signal thereby generated could be employed to access the prerecorded drum signal and to cause that signal to be directed to a recorder or sound reproduction apparatus, instead of or in addition to the signal produced by the device.

The described arrangement permits the arm 48 to be swung about the axis of the portion 48*b*, and the head structure 18 may likewise be swung about the axis of the portion 48*c*. The consequent ability to manipulate the position and orientation of the head structure on the drum skin or other instrument surface, and the aforedescribed ability to move the arm 48 and head structure 18 in the lengthwise direction of the arm portion 48*b*, permit ready adaptation of the device 12 to fit various sizes and types of instrument, and furthermore permit variation of the position and orientation of the head structure on the instrument surface. For example, the sound signals produced when the head structure 18 is located close to the edge of a drum skin will contain differenct overtones to those produced when the head structure is located closer to the centre of the drum skin, and ability to vary the position and orientation of the head permits a musician to select a suitable sound quality for the instrument, as desired.

The described construction has been advanced merely by way of explanation and many modifications and variations may be made thereto without departing from the spirit and scope of the invention as defined in the appended claims.

The claims defining the invention are as follows:

1. A transducer device for a percussive musical instrument having a surface which vibrates comprising:

a transducer effective when subjected to audio frequency vibration to produce a corresponding electrical signal output, and a mounting structure for mounting the transducer to the instrument such that it contacts said surface for transmission of vibration of said surface directly to the transducer, to produce said corresponding signal output wherein said mounting structure in use presses the transducer towards said surface, and wherein said transducer is a piezo-electric device incorporated into a head structure comprising two relatively rigid elements, between which the piezo-electric device is clamped, and a resilient member connecting said head structure to said mounting structure, said resilient member mechanically isolating said head structure to reduce transmision of vibration to said head structure via the mounting machine.

2. A transducer device as claimed in claim 1, wherein said resilient member is formed of foam rubber or foam plastics.

3. A transducer device as claimed in claim 1, wherein said mounting structure comprises a mounting element attachable to an arm extending therefrom and couplable at an end thereof remote from the mounting element to said head structure means being provided for exerting a force on the transducer via the arm, to effect the pressing of the transducer towards said surface.

4. A transducer device as claimed in claim 3, wherein the coupling of said arm to the head structure is effected via a vibration dampening element.

5. A transducer device as claimed in claim 1, wherein the transducer device includes means effective to analyse electrical signal produced thereby and provide an indication of the frequency of the vibrations detected by the device.

6. A transducer device as claimed in claim 1, wherein a preamplifier is provided for the transducer, which preamplifier incorporates the modification circuitry.

7. A transducer device as claimed in claim 6, wherein said tone modification circuitry comprises a parametric equalizer.

* * * * *